US005141276A

United States Patent [19]

McClure

[11] Patent Number: 5,141,276

[45] Date of Patent: Aug. 25, 1992

[54] BOILER TUBE GRIPPER

[76] Inventor: Matthew P. McClure, Rte. 7, Box 228A, S. Charleston, W. Va. 25309

[21] Appl. No.: 729,348

[22] Filed: Jul. 12, 1991

[51] Int. Cl.[5] ..... B66C 1/44

[52] U.S. Cl. ..... 294/92; 294/104

[58] Field of Search ..... 294/67.3, 82.18-82.21, 294/90-92, 101, 104, 106

[56] References Cited

U.S. PATENT DOCUMENTS

| | | | |
|---|---|---|---|
| 281,492 | 7/1883 | Green | 294/92 X |
| 843,820 | 2/1907 | Imhoff | 294/92 |
| 1,021,984 | 4/1912 | Holmes | 294/90 |
| 1,433,624 | 10/1922 | Johnston | 294/92 |
| 1,435,772 | 11/1922 | Whittaker | 294/92 |
| 2,013,621 | 9/1935 | Beal et al. | 294/90 |
| 2,122,513 | 7/1938 | Conner | 294/90 |
| 2,584,902 | 2/1952 | Miller | 294/92 X |
| 2,820,999 | 1/1958 | Meltzer et al. | 294/67.3 |
| 2,875,982 | 3/1959 | Unglesby | 294/90 X |
| 4,951,989 | 8/1990 | Goodin | 294/90 |

*Primary Examiner*—Johnny D. Cherry

*Attorney, Agent, or Firm*—Fleit, Jacobson, Cohn, Price, Holman & Stern

[57] ABSTRACT

A boiler tube gripper including a pair of pivotally connected members each of which is generally hook-shaped and provided with a generally semi-cylindrical inner surface to form a cylindrical opening when the pivotal members are pivoted to a closed position in encircling relation to a boiler tube or pipe with a lift element connected to one of the pivotal members at the periphery thereof to tilt the closed gripper which causes the diametrically opposed upper and lower edges of the closed gripper to engage the adjacent and remote surfaces of a boiler tube or pipe being gripped while being lifted and handled. The free ends of the pivotal members have a pin securing them in closed position with the pin being tethered to retain it in accessible position with the tether also serving to effectively release the pivotal members by pivoting one of the members toward open position.

6 Claims, 1 Drawing Sheet

BOILER TUBE GRIPPER

BACKGROUND OF THE INVENTION

1. Field of the Invention

The present invention generally relates to a device for effectively gripping and supporting boiler tubes or similar pipe when they are being lifted and positioned in a vertical position. More specifically, the gripper includes a pair of pivotally connected members each of which is generally hook-shaped and provided with a generally semi-cylindrical inner surface to form a cylinder when the pivotal members are pivoted to a closed position in encircling relation to a boiler tube or pipe with a lift element connected to one of said pivotal members at the periphery thereof to tilt the closed gripper which causes the diametrically opposed upper and lower edges of the closed gripper to engage the adjacent and remote surfaces of a boiler tube or pipe being gripped while being lifted and handled. The free ends of the pivotal members have a pin securing them in closed position with the pin being tethered to retain it in accessible position with the tether also serving to effectively release the pivotal members by pivoting one of the members toward open position.

2. Description of the Prior Art

Various types of clamps and lifting and handling devices have been provided for handling relatively heavy cylindrical objects such as pipes, rods and the like. When installing boiler tubes, it is necessary that relatively long and heavy boiler tubes be lifted and oriented n a generally vertical position especially when replacing boiler tubes. The following U.S. patent relate generally to lifting and handling devices:

1,627,733
1,118,618
1,435,772
2,650,852
2,997,327

None of the above patents disclose the specific structure and use of the boiler tube gripper of this invention.

SUMMARY OF THE INVENTION

An object of the present invention is to provide a boiler tube gripper for lifting and handling boiler tubes or similar pipe when in a generally vertically disposed, suspended position with the gripper securely supporting boiler tubes but yet easily attached to and disconnected from boiler tubes or similar pipes.

Another object of the invention is to provide a boiler tube gripper incorporating a pair of generally hook-shaped members having inwardly facing semi-cylindrical surfaces with the members including a pivotal connection adjacent one end thereof to enable the free ends thereof to swing outwardly into an open position and inwardly towards each other to a closed position encircling a boiler tube or pipe.

A further object of the invention is to provide a boiler tube gripper as set forth in the preceding objects in which the pivotal members include alignable apertures for receiving a locking pin to retain the members in closed position with the locking pin being tethered to one of the members to retain the pin in accessible position and also provide a tension line by which the pivotal member to which the tether line is attached can be easily opened to remove the gripper from a boiler tube or pipe.

Still another object of the invention is to provide a boiler tube gripper in accordance with the preceding objects in which the closed pivotal members define a cylindrical interior of larger diameter than the boiler tube or pipe being gripped with a lift line being connected eccentrically to the gripper to tilt it so that the opposite adjacent and remote diametric top and bottom edges of the gripper will engage diametrically opposed portions of the boiler tube or pipe for securely connecting the boiler tube gripper to the boiler tube to safely lift and handle boiler tubes in an efficient manner.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
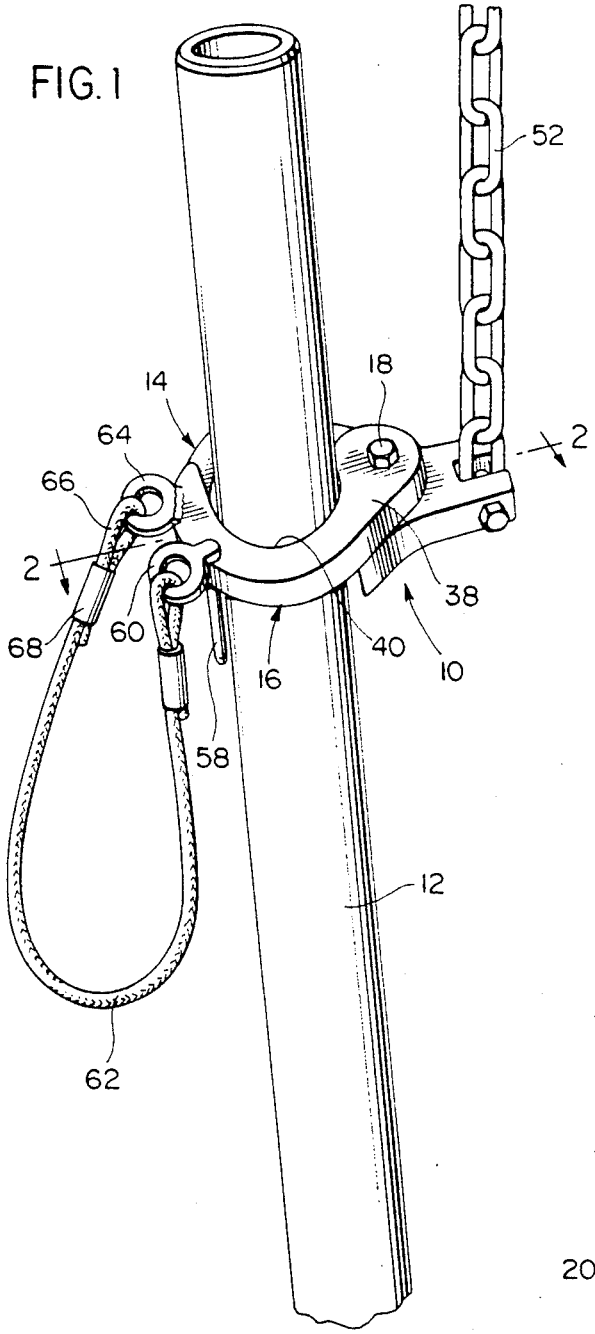
FIG. 1 is a perspective view of the boiler tube gripper of the present invention.
Figure 2:
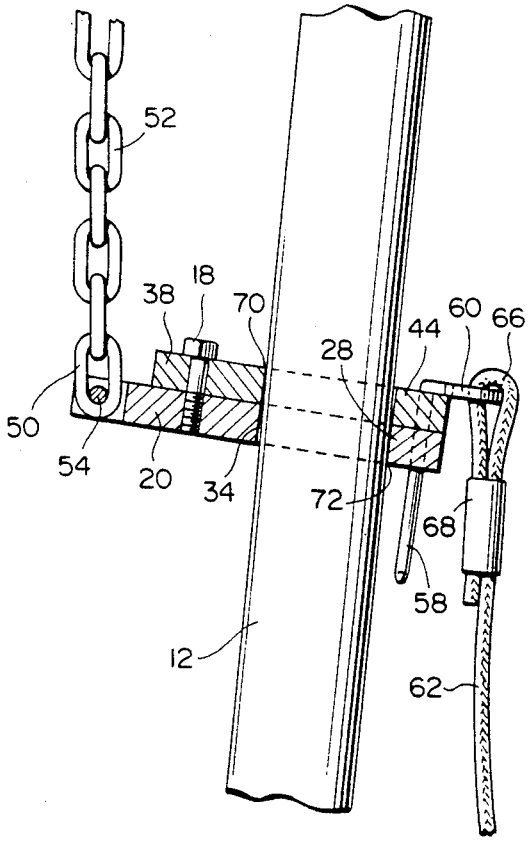
FIG. 2 is a transverse, sectional view taken along section line 2—2 on FIG. 1 illustrating the structural details of the gripper.

Referring now specifically to the drawings, the boiler tube gripper of the present invention is generally designated by reference numeral 10 and is specifically adapted for use in supporting and handling a boiler tube 12 especially when the boiler tube is oriented in a generally vertical position such as is necessary when replacing a boiler tube in a boiler.

Figure 3:
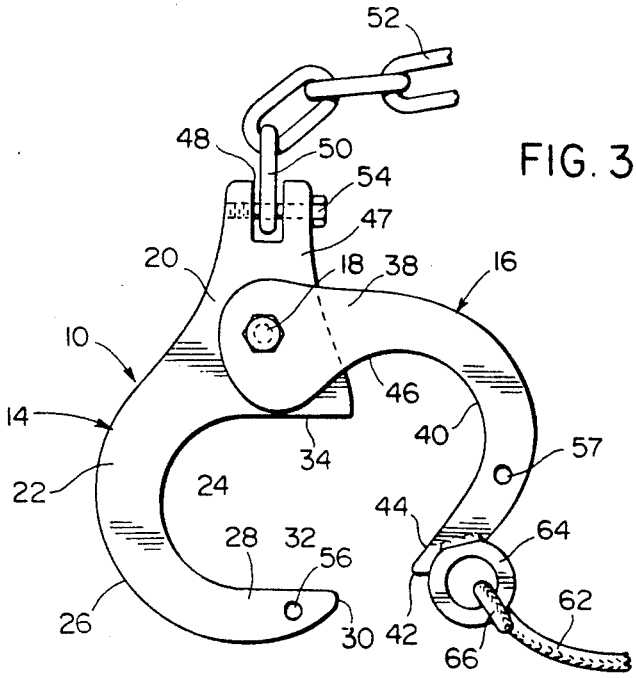
FIG. 3 is a top plan view of the boiler tube gripper in open position.

The boiler tube gripper 10 includes a pair of generally hook-shaped members 14 and 16 which are pivotally interconnected by a pivot bolt 18. The member 14 includes a shank portion 20 which extends into an arcuate portion 22 having a generally semi-cylindrical inner surface 24 and a correspondingly curved outer surface 26 with the free end of the curved portion 22 being designated by reference numeral 28 and including a rounded free end 30 and a generally straight edge portion 32 that is substantially tangential to the surface of the boiler tube 12. The end portion of the semi-cylindrical surface 24 adjacent the shank 20 also includes a generally straight portion 34 that is tangential to the pipe 12 and forms a lateral extension on the shank 20 so that it underlies a substantial portion of the shank 38 of the hook-shaped member 16. The hook-shaped member 16 also includes a generally semi-cylindrical surface 40 which terminates in a rounded free end edge 42 which forms a transition curved edge 44 where it merges with the semi-cylindrical surface 40 which extends beyond a diameter of the pipe in the same plane as the pivot bolt 18. The inner end of the curved surface 40 merges with and flares inwardly at 46 to form the shank portion 38 of the pivotal member 16. The shank portion 38 of the pivotal member 16 overlies and engages the corresponding surface of the shank 20 to enable pivotal movement of the members 14 and 16 in relation to each other to enable the overlapping ends 30 and 42 to be moved between the closed position illustrated in FIG. 1 and the open position illustrated in FIG. 3. The specific configuration of the semi-cylindrical surfaces 24 and 40 is such as to orient the free end portions of the surfaces in overlapping relationship to each other with the surfaces extending beyond the outermost edge portion of the tube 12 to retain the members in closed position by their engagement with the outer surface portions of the tube.

The shank portion 20 of the pivotal member 14 includes an extension 47 which is bifurcated or provided with a notch 48 receiving a link 50 of a flexible chain 52 therein with a threaded bolt 54 extending across the notch and through the link 50 to detachably connect the chain to the gripper 10. The chain or other similar lift member is connected to a lifting apparatus such as a hoist or the like which can lift the gripper 10 along with the tube or pipe 12 in the manner illustrated in FIG. 1.

The outer end portions of the pivotal members 14 and 16 include alignable locking apertures 56 and 57 to receive a locking pin 58 having a tapered end on one end thereof and a laterally extending loop or eye 60 at its other end to which a tether line 62 is attached with the tether line being in the form of a flexible rope, cable or the like. The other end of the tether line 62 is anchored to a laterally extending loop 64 welded to or otherwise attached to the outer surface of the terminal end portion 44 of the pivotal member 16 with the tether line 62 being secured to the loops or eyes 60 and 64 by a loop 66 formed in the end of the flexible rope 62 by a crimped clamp band 68 or some similar structure.

The semi-cylindrical surfaces have a substantial thickness and the surface defining the semi-cylindrical surfaces is perpendicular to the top and bottom surfaces of the pivotal members 14 and 16. The effective diameter of the semi-cylindrical surface in a vertical plane passing through the pivot bolt 18 and the center of the semi-cylindrical surfaces is greater than the outside diameter of the tube or pipe to an extent that permits the gripper to pivot slightly in relation to the longitudinal axis and surfaces of the tube 12 thereby causing the upper inner edge of the generally cylindrical interior of the pivotal member 16 when in closed position to engage or bite into the surface area of the tube 12 which it engages at 70. Likewise, the bottom corner edge of the diametrically opposed outer portion of the cylindrical area defined by the curved surface 24 on the pivotal member 14 will engage and bite into the surface area of the tube 12 at 72 which is below and diametrically opposed to the surface area at 70 engaged by the upper edge of the pivotal members 14 and 16 adjacent the pivot bolt 18. This provides an effective and secure gripping engagement between the gripper and the boiler tube 12 and the pin inserted in the bores or apertures 56 and 57 assures that the gripper will remain in engagement with the tube 12 even when the tube is not being lifted such as when assembling the gripper on the tube or moving it longitudinally thereof before the lifting operation starts. When the tube has been lifted into position in the boiler, the gripper can be easily released by manually removing the pin and pulling on the line 62, preferably by using a jerking motion, which will pivot the pivotal member 16 about the pivot bolt 18 thus opening the gripper and enabling the other pivotal member 14 to be separated from the tube 12 by movement laterally from the tube 12. By using the gripper of this invention to lift boiler tubes, considerable savings in time and energy as well as increased safety is accomplished as compared to presently used conventional techniques in handling and lifting boiler tube which includes manual lifting and handling, lifting by tieing a rope around the tube or using some type of screw threaded clamp attached to the tube. This device is relatively simple to operate in that the lateral opening on the pivotal member 14 enables easy assembly laterally onto the boiler tube with the pivotal member 16 then being simply pivoted into closed position and the pin inserted to secure the gripper to the tube or pipe.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A gripper for lifting and handling elongated cylindrical objects such as boiler tubes comprising a pair of pivotal members of generally arcuate configuration and provided with opposed, facing generally semi-cylindrical recesses, means pivotally connecting one end of each of said pivotal members to enable the pivotal members to pivot in relation to each other from a closed position with the opposed semi-cylindrical recesses forming a generally cylindrical opening for encircling a cylindrical object to be lifted and handled to an open position to enable the cylindrical object to be removed from the recesses, means on one of said pivotal members adjacent the pivotally connecting means between said pivotal members to connect a lifting device thereto, the diameter of the generally cylindrical opening formed by the semi-cylindrical recesses being greater than the diameter of the cylindrical object whereby lifting force on the pivotal members when in closed position will tilt the gripper in relation to the longitudinal axis of the cylindrical object to lock the gripper to the cylindrical object, said pivotal members including ends remote from the means pivotally connecting said members which are positioned in overlapping relation in the closed position and means releasably locking the overlapping ends of the pivotal members in overlapped relation to securely retain the gripper assembled with respect to the cylindrical object, the semi-cylindrical recess in said one pivotal member including generally parallel laterally extending end portions which are generally tangential to a cylindrical surface of the cylindrical object being lifted and extend beyond a center line of the cylindrical object, said means releasably locking the overlapping ends in overlapped relation including alignable bores in the overlapping ends of the pivotal members and a pin insertable into the aligned bores to retain the overlapped ends of the pivotal members in overlapped relation.

2. The gripper as defined in claim 1 wherein said pin is connected to one of the overlapping ends by a flexible tether line to retain the pin in accessible position when not inserted into the bores, said tether line providing means to pivot one of the pivotal members toward open position when exerting tension force on the tether line.

3. The gripper as defined in claim 2 wherein said means for connection with a lifting device includes a shank extension on said one of said pivotal members with the shank extension terminating in a notch, a fastener extending across the notch and a chain link on a lifting chain mounted on said fastener.

4. The gripper as defined in claim 3 wherein said means pivotally connecting said pivotal members includes a pivot bolt extending through said pivotal members adjacent the shank extension.

5. The gripper as defined in claim 4 wherein said semi-cylindrical recesses are defined by surfaces having spaced upper and lower edges whereby the edges will effectively grip the cylindrical object when the gripper is tilted with respect to the longitudinal axis of the cylindrical object when lifting the cylindrical object to securely grip opposed and longitudinally spaced surface areas of the cylindrical object during lifting and handling.

6. The gripper as defined in claim 5 wherein the shank extension includes a surface extending substantially laterally to both sides of the pivot bolt, one of said generally parallel end portions of the pivotal member having the shank extension thereon having a substantially straight surface terminating in a rounded end having one of said bores adjacent thereto, a plane extending through the chain link, pivot bolt and end portion of the pivotal member having the shank extension thereon being positioned inwardly of the bore adjacent the rounded end, the other pivotal member having a generally pointed end having a substantially straight inner surface extending therefrom, the other of said bores being positioned in the end portion of the other pivotal member in a position that a substantial portion of the end portion of the other pivotal member extends beyond the bore in the end portion of said one pivotal member, said tether line being connected to a loop on the end portion of the other pivotal member between the bore and the pointed end to exert force on the end portion of the other pivotal member when tension is exerted on the tether line.

* * * * *